US008188990B2

(12) United States Patent
Zamorsky et al.

(10) Patent No.: US 8,188,990 B2
(45) Date of Patent: May 29, 2012

(54) DISPLAY METHOD AND SYSTEM FOR STIMULATING THE BLINKING OF THE EYES OF A USER BY SUBLIMINAL MODIFICATION OF DISPLAY PARAMETERS

(76) Inventors: Maximilian Zamorsky, Vienna (AT); Alexander Hartenau, Vienna (AT)

( * ) Notice: Subject to any disclaimer, the term of this patent is extended or adjusted under 35 U.S.C. 154(b) by 791 days.

(21) Appl. No.: 11/569,668

(22) PCT Filed: May 28, 2004

(86) PCT No.: PCT/AT2004/000187

§ 371 (c)(1),
(2), (4) Date: May 27, 2008

(87) PCT Pub. No.: WO2005/116973

PCT Pub. Date: Dec. 8, 2005

(65) Prior Publication Data

US 2008/0259098 A1 Oct. 23, 2008

(51) Int. Cl.
*G09G 5/00* (2006.01)

(52) U.S. Cl. ..... 345/204; 345/9

(58) Field of Classification Search ..... 345/204, 345/589–605, 690, 691, 4, 6, 7, 9
See application file for complete search history.

(56) References Cited

U.S. PATENT DOCUMENTS

| | | | | | |
|---|---|---|---|---|---|
| 3,923,044 | A | * | 12/1975 | Miller | 601/37 |
| 4,794,386 | A | * | 12/1988 | Bedrij et al. | 715/803 |
| 5,263,678 | A | * | 11/1993 | Birkbeck | 248/657 |
| 5,270,800 | A | | 12/1993 | Sweet et al. | |
| 5,333,009 | A | | 7/1994 | Gell, Jr. et al. | |
| 5,384,593 | A | | 1/1995 | Gell, Jr. et al. | |
| 5,933,130 | A | * | 8/1999 | Wagner | 345/690 |
| 6,075,525 | A | * | 6/2000 | Hsieh | 345/589 |
| 6,091,399 | A | * | 7/2000 | Sumiyoshi et al. | 345/600 |
| 6,270,467 | B1 | * | 8/2001 | Yee | 601/37 |
| 6,533,417 | B1 | * | 3/2003 | Sain | 351/203 |
| 7,036,025 | B2 | * | 4/2006 | Hunter | 713/300 |
| 7,446,762 | B2 | * | 11/2008 | Hsieh et al. | 345/204 |
| 2002/0008696 | A1 | * | 1/2002 | Wagner | 345/204 |
| 2002/0075289 | A1 | * | 6/2002 | Hatori et al. | 345/698 |
| 2003/0040680 | A1 | * | 2/2003 | Hassert et al. | 600/558 |
| 2005/0206584 | A1 | * | 9/2005 | Hsieh et al. | 345/9 |

FOREIGN PATENT DOCUMENTS

| | | | |
|---|---|---|---|
| FR | 2406225 | A | 5/1979 |
| WO | WO 90/12470 | A | 10/1990 |

* cited by examiner

*Primary Examiner* — Abbas Abdulselam
*Assistant Examiner* — Dmitriy Bolotin
(74) *Attorney, Agent, or Firm* — Workman Nydegger

(57) ABSTRACT

In a method for displaying visual information (9) on a display surface (3, 13, 20, 21), a display parameter (P) is modified, at trigger intervals, in at least one region of the display surface (3, 13) for a subliminal period of time. The display parameter (P) is preferably selected from the brightness, color, illumination, contrast, focus, frequency or connection/disconnection of the display. By said measure, a viewer of the display surface (3) is prompted to perform a blinking movement which leads to the moistening of the eye with tear fluid and thereby prevents eye irritation without the viewer consciously perceiving the externally controlled blinking.

21 Claims, 3 Drawing Sheets

Figure 1:
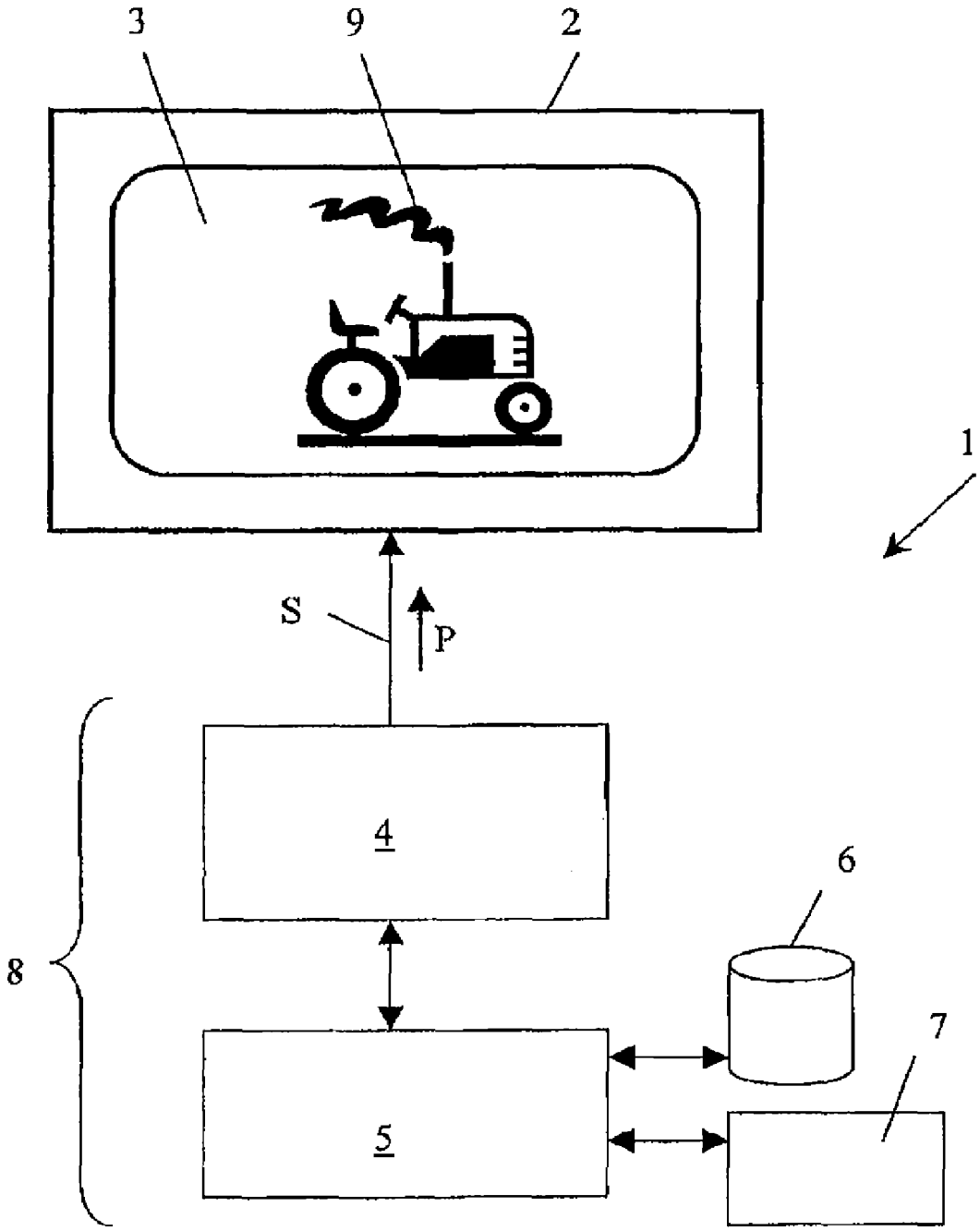

DISPLAY METHOD AND SYSTEM FOR STIMULATING THE BLINKING OF THE EYES OF A USER BY SUBLIMINAL MODIFICATION OF DISPLAY PARAMETERS

The invention relates to a method and a system for displaying visual information on a display surface.

Between 1997 and 2001, eye diseases experienced a 30 percent increase in Austria; similar numbers can be observed internationally. In contrast to actual diseases, temporary disorders such as the so-called "dry eye", also referred to as the "office eye syndrome" or "red eye syndrome", can be alleviated or prevented, respectively, by regular training before damage to the eye is caused. However, studies have shown that (autonomous) training is hardly ever performed, or only after the occurrence of symptoms, respectively—i.e., when irritations have already developed. Eye disorders, also known as the computer vision syndrome (CVS), occur particularly often at work and during car journeys, since there the eyes are exposed to an unfavourable environment. Said environment is composed of the following factors: heating or air conditioner, respectively, as well as working in front of a screen/constant focus, whereby those factors have a mutually accelerating effect on each other, since both promote the desiccation of the eyes. The former dry up the air and hence the eye's environment. In addition, working in front of a screen/constant focus prevents blinking which compensates for the dry air, wherein the eye is coated each time with a tear film and thus remains moist. If permanent moistening is stopped, the eye surface will become dry, which is perceivable by burning, itching, redness, drawing pain in the eye as well as headaches. The concentration necessary for working in front of a screen/constant focus causes us to keep our eyes open for an unusually long time ("to stare") and also, if initial fatigue sets in, to become cramped in this posture. In addition, the eye is slowly blinded by the screen's long and constant radiation.

Except when working in front of a screen, the above-described irritations of the eye also occur during strenuous reading or when looking at projections. In industrial fields, there are also many jobs which require concentrated gazing at a constant focus, e.g., for the visual inspection of industrial products manufactured in production lines. As a result of the development in the automobile industry, head-up displays (in the following referred to as HUD) will, in the near future, be installed as standard in motor vehicles. In HUD's, the reaction time for refocusing from far vision to close vision and vice versa is indeed omitted, which results in a shorter driver reaction time; however, the permanent gaze on the street or on the information faded in by the HUD, respectively, will also lead to the above-described symptoms.

From the published U.S. patent application US 2003/0218721 A1, a system and a method for an optimized view of computer monitors are known, which aim at minimizing the strain on the viewer's eyes. The method comprises determining an optimum distance between the computer monitor and the viewer and monitoring the distance between the computer monitor and the viewer when the computer is used. According to said method, the user is alerted if he or she does not keep the optimum distance that has been determined. Furthermore, various eye tests can be performed with the aid of the computer monitor.

However, by means of said known system and method, only one specific problem is solved to some extent, namely that, for a display with a particular screen diagonal, a corresponding optimum distance between the viewer and the screen should be maintained. If, however, the viewer keeps this recommended distance, an even greater danger of eye irritation will arise for him due to the eye's steady focussing. A problem which remains unsolved is that concentrated work in front of a screen and the constant focus of a viewer's eye onto the screen will result in the prevention of blinking, which is of utmost importance for the moistening of the eye with tear fluid, hence drying up the eye surface.

Thus, there is still a need for providing a solution as to how the known eye irritations can be reduced or ideally even completely prevented by making sure that the eye is coated with a tear film by blinking with sufficient frequency, whereby the eye remains moist.

The invention solves this problem by providing a method and a system for displaying visual information on a display surface, wherein a display parameter is modified, at trigger intervals, in at least one region of the display surface for a subliminal period of time which is below the human perception threshold.

The inventors can take the credit for having discovered that blinking, which is forgotten or unconsciously suppressed, respectively, by concentrated gazing such as, e.g., when working in front of a screen or by steadily focussing the eye, can be triggered in an externally controlled manner by repeatedly modifying a display parameter in at least one region of the display surface for a subliminal period of time which is below the human perception threshold. What is fascinating about this idea is that a viewer will not notice anything when he or she is subjected to said external triggering of the blinking process, since it occurs in the subliminal range, i.e., only for such a short time that the human brain will fail to consciously perceive this modification of the display parameter. The eye, however, will again and again (maybe not necessarily each time) respond to this modification of the display parameter and blinking will be triggered. Just as a person in the relaxed state fails to notice that he or she blinks at regular intervals, the triggering of the blinking process, which, according to the invention, is controlled externally, will not cause an unpleasant sensation, as it is produced, for example, when the eyes are blinded by bright light such that the eyelids are involuntarily closed. Rather, the blinking, which, according to the invention, is triggered in an externally controlled manner, will be the cause for an improved well being of the viewer, since the blinking of the eye occurs harmoniously at regular intervals and, thus, the eye is always moistened to a sufficient degree, whereby, in the following, the concentration is improved and work is made easier.

It should be noted that it has long been known to fade so-called "subliminal information", that is information the duration of which is below the identification ability of the human brain, into films, videos or television signals. It has been proven that a viewer is indeed incapable of consciously perceiving the subliminal information while, subconsciously, he or she is still responding to it. This effect is used, for example, for putting a message into a person's mind, for instance, the message "eat less". However, this effect of bringing in subliminal information has nothing to do whatsoever with the present invention. According to the invention, the displayed information is not changed, influenced or replaced by different information but a display parameter is modified to such an extent that an optimum eyelid movement can thereby be achieved, whereby the moistening of the eye is ensured and fatigue and inflammation phenomena are prevented. Thus, the display of visual information is rendered much safer for the eye than what is the case with conventional display systems and consequently leads, also in general, to an increased well being of the viewer.

According to the invention, the blinking of the eye is remote controlled by modifying a display parameter in at least one region of the display surface for a subliminal period of time which is below the human perception threshold. The brightness, colour, illumination, contrast, focus, frequency or connection/disconnection of the display is preferably selected as the display parameter to be modified. Namely, it has been shown that a blinking movement can be induced in this manner, which is certainly not perceived as unpleasant by the viewer of the display surface and as a result of which he or she will not be distracted or limited in his or her activity.

The subliminal period of time within which a person is incapable of consciously perceiving modifications of a display parameter varies from individual to individual and also according to the daily condition etc. However, it has been proven that the subliminal period of time is in any case short enough if it does not exceed 0.06 s. Optionally, it is also envisaged that the viewer is able to adjust the subliminal period of time in order to optimally adapt it to his or her own sensitivity.

In an advanced embodiment of the invention, it is also provided that, at time intervals which are larger than the trigger intervals, the display parameter is modified in at least one region of the display surface for an optionally adjustable supraliminal period of time which is above the human perception threshold. In this way, the user obtains the certainty that the method will be processed and the user is also consciously reminded of the effectiveness and the mode of operation.

The trigger interval defines at what time intervals the modification of the display parameter is performed. In tests, a trigger interval of between 5 and 20 s has proven to be suitable for sufficiently moistening the eye with tear fluid. To enable individual adaptation to the personal preferences and needs of a viewer, it appears to be suitable if the trigger interval can be set to a value which is kept constant or varied randomly by the viewer of the display surface or by a random generator or the like. In a further embodiment of the invention, it is also envisaged that the trigger interval is adjusted according to a value profile, which profile can, for example, be a daily profile or a profile adapted to the ambient brightness. In order that the trigger interval is not adjusted to values so extreme that the blinking frequency caused thereby will be too high and thus interfering, or too low and thus ineffective, it is furthermore envisaged that the variability of the trigger interval is made possible only within predetermined limits.

In cases in which the display surface is integral with a display, it has turned out to be advantageous based on a simple implementation if the modification of the display parameter is caused by changing the control of the display.

However, the display surface can also be a projection surface or a support surface provided with the visual information, such as, for example, a print. For example, a surface of an article, in particular of an industrial product, which surface is to be inspected visually by an operator can, however, also be regarded as a display surface. In the above-mentioned cases, the display surface itself for the most part cannot be changed directly but results from irradiation with natural or external light. In order to be able, however, to carry out the method according to the invention also in such cases, it is envisaged that a display parameter of the display surface is modified by irradiating the display surface with light from a source of light, i.e., the support surface or the article, respectively, is irradiated with light from the source of light for a subliminal period of time.

Tests have shown that a viewer rarely looks at an entire display surface but, when viewing the surface, focuses on specific regions of the display surface which momentarily attract his attention. Such regions comprise, for example, regions of the display surface in which a cursor, a mouse pointer, an input field, an active screen window or another indicator attracting the viewer's attention is located. However, by measurements such as iris identification, it is, for example, also possible to detect on what region of a display surface a viewer's attention is focussed. The inventors have realized that it is sufficient for the purposes of the invention if a display parameter is modified only in such a region of the display surface on which the viewer's current attention is focussed. The modification of a display parameter only in a partial region of the display surface is often easier to technically implement than a change of the entire display surface.

The method according to the invention is perfectly suitable for implementation via a computer, whereby different approaches can be selected. If, for example, the method is processed in a computer which has an operating system that allows the display of several superimposed display levels on a display surface, a transparent region can be provided as the uppermost display level, which transparent region is switched, for the subliminal period of time, into a mode which is not entirely transparent according to the display parameter. If such a computer is furthermore designed for the display of display windows, a transparent window can be placed over at least one area of the visual information and the transparent window can be switched, for the subliminal period of time, into a mode which is not entirely transparent according to the display parameter. In yet another alternative embodiment of the method according to the invention, in a computer having an operating system which is designed for the display of several display windows of which one display window is selectable as an active display window acted upon by user inputs, a display parameter can be modified in the active window. In yet another alternative embodiment of the invention, said invention being implemented in a computer with an operating system that allows the display of several superimposed display windows on a display surface, the modification of a region of the display surface can be effected, according to the invention, by means of a window faded in for the subliminal period of time and exhibiting display properties which have been predetermined by the display parameter.

In order to solve the problem of the invention, it is envisaged according to the invention that, in a computer program product suitable for displaying visual information on a display surface, the computer program product is loadable directly into a memory of a computer and comprises software code portions, whereby the method can be processed according to the invention by means of the computer if the computer program product is processed on the computer. The computer program product can be stored on a computer-readable medium.

In order to solve the problem of the invention, it is envisaged for a computer according to the invention that the computer comprises an arithmetic unit and an internal memory and processes the computer program product according to the above-indicated paragraph.

The present invention also comprises a display system with a display and at least one display device that displays an image on a display surface of the display. According to the invention, the display device is acted upon by display modifying means which are designed for modifying, at trigger intervals, a display parameter in at least one region of the display surface for a subliminal period of time which is below the human perception threshold. The display parameter is preferably selected from the brightness, colour, illumination, contrast, focus, frequency or connection/disconnection of the display. As already mentioned above, the subliminal period of time varies from individual to individual and also throughout the course of the day. Preferably, the subliminal period of time is determined to be 0.06 seconds at the most, since tests have shown that, with this value, the invention provides good results for everyone, whereas, as stated above, longer periods of time are also useful in individual cases. In order to achieve optimum results for different individual sensitivities, it is envisaged that the subliminal period of time is adjustable. In order to adapt to different individual preferences and needs, it may also be provided that the trigger interval is made adjustable to a value or a value profile by a user or a random generator, with the variability of the trigger interval preferably lying within predetermined limits in order to prevent undesired results. In order to prevent excessive uniformity during the subliminally short modification of a display parameter, which might possibly reduce the effect of the externally controlled triggering of blinking, it is provided in an advanced embodiment of the display system according to the invention that the position and/or the size of the region of the display surface which is modified is/are variable. When varying the position and/or the size of said region, the technical performance of the display modifying means can also be taken into consideration.

Figure 2:
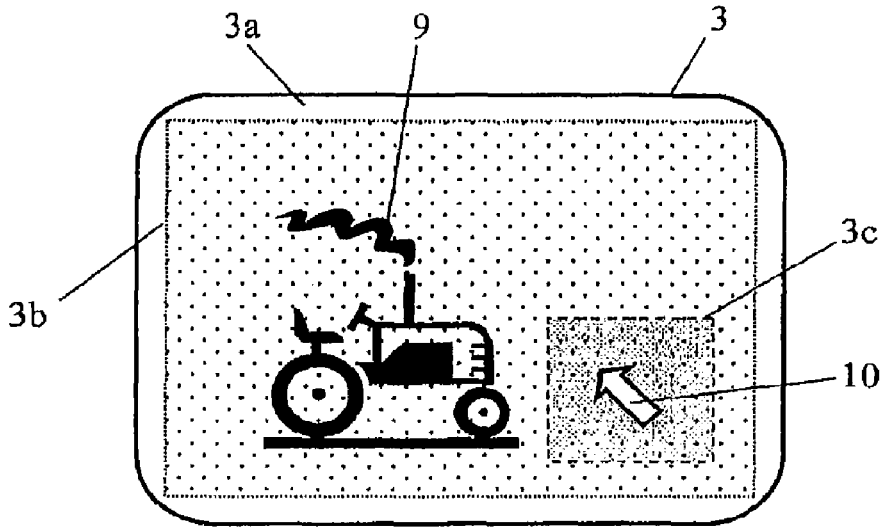
Figure 3:
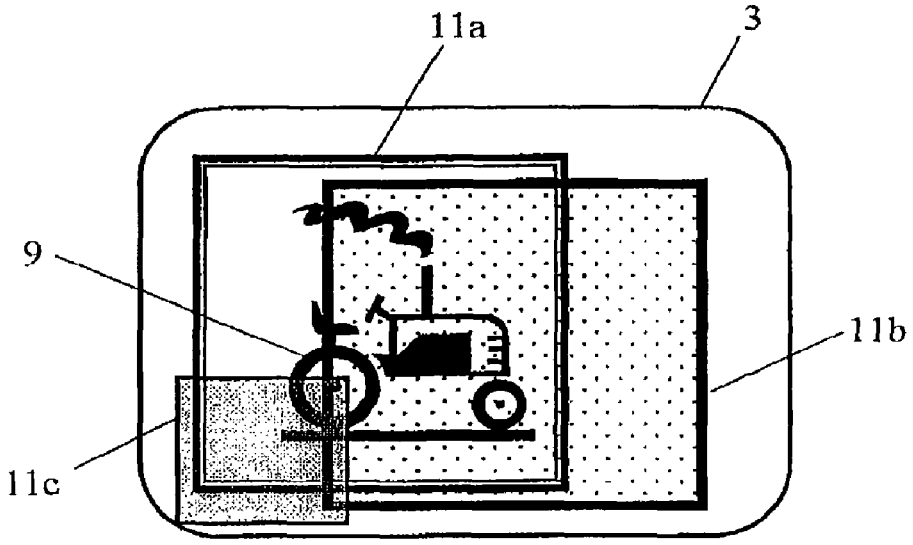
Figure 4:
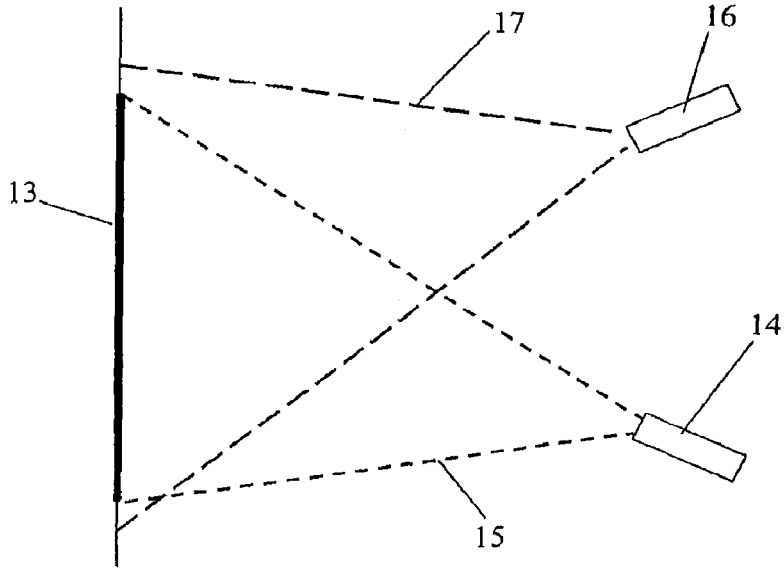
Figure 5:
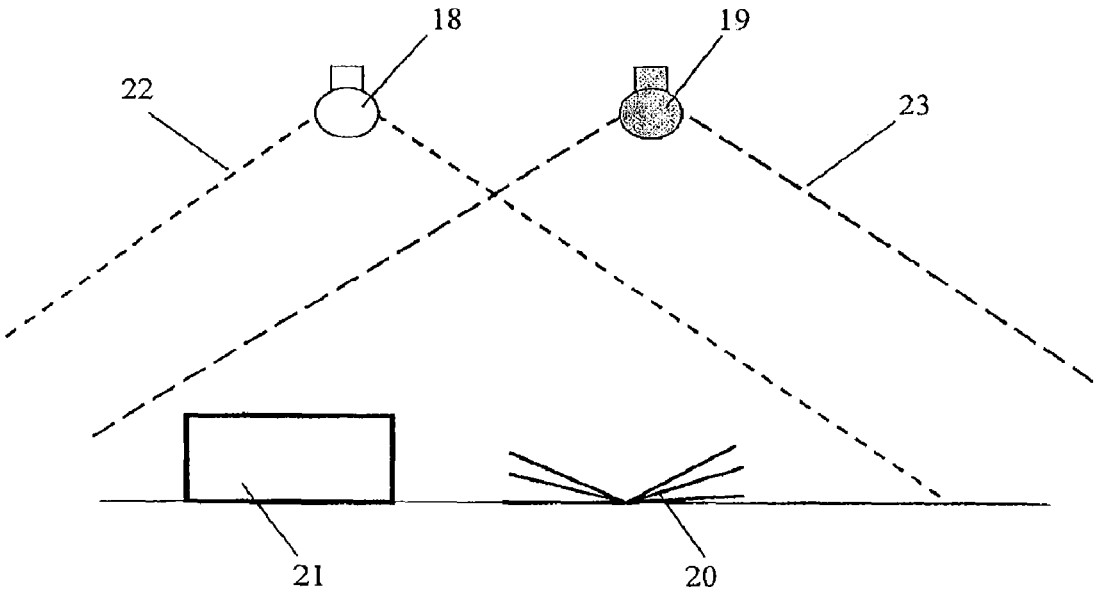

The invention is now illustrated further by way of non-limiting exemplary embodiments, with reference to the drawings. In the drawings, FIG. 1 shows a block diagram of a display system 1 according to the invention, FIG. 2 shows a display surface for illustrating an embodiment of the method according to the invention, FIG. 3 shows a display surface for illustrating another embodiment of the method according to the invention, FIG. 4 schematically shows a display system wherein the display surface is designed as a projection surface, and FIG. 5 shows a further display system according to the invention wherein the display surface is defined by a support surface containing visual information.

FIG. 1 shows a block diagram of a display system 1 according to the invention. The display system 1 comprises a display 2 with a display surface 3 for displaying visual information 9 or images, respectively, whereby those two terms are to be interpreted broadly and cover any form of text, graphic or other information which can be shown on the display surface. Although, in FIG. 1, the display is illustrated as a screen, it is not limited thereto but comprises all kinds of displays such as, for example, electroluminescence displays, vacuum fluorescence displays, plasma displays, cathode ray tubes, LCDs, head-up displays, but also projectors, video beamers and the like. The display 2 is controlled by a display device 4 which delivers the respective control S for displaying the visual information 9 as well as the display parameters P to the display, by means of which display parameters P the display properties of the display surface are determined. The display parameters P comprise the brightness, colour, illumination, contrast, focus, frequency of the display or the like. According to the invention, the display system 1 furthermore comprises display modifying means 5 acting upon the display device 4, which display modifying means are designed for modifying, at trigger intervals, a display parameter P in at least one region of the display surface 3 for a subliminal period of time which is below the human perception threshold.

This is to say, the inventors have realized that, by concentrated gazing such as, e.g., when working in front of a screen or by steadily focussing the eye, blinking, which is forgotten or unconsciously suppressed, respectively, can be triggered in an externally controlled manner by repeatedly modifying a display parameter in at least one region of the display surface 3, whereby said modification has to occur only for the above-mentioned subliminal period of time which is below the human perception threshold. What is fascinating about this idea is that a viewer will not notice anything when he or she is subjected to said external triggering of the blinking process, since it occurs in the subliminal range in which the human brain does not yet consciously perceive this modification of the display parameter. The eye, however, will respond to this modification of the display parameter and blinking will be triggered as desired. The viewer fails to notice this externally triggered blinking just as a person in the relaxed state generally does not notice that he or she blinks at regular intervals. Therefore, said triggering of the blinking process, which, according to the invention, is controlled externally, will also not cause an unpleasant sensation for the viewer of the display surface 3 but will rather increase the viewer's well being, since the blinking of the eye occurs harmoniously at regular intervals and, thus, the eye is always moistened to a sufficient degree, whereby eye irritations are reliably prevented and the so-called, "red eye syndrome" is eliminated. Frequently, the reduced strain on the eye will also result in a more relaxed body posture of the viewer, which is very important especially for workplaces involving screens.

The subliminal period of time within which a person is incapable of consciously perceiving modifications of a display parameter varies from individual to individual and also according to the daily condition etc. However, it has been proven that the subliminal period of time is in any case short enough if it does not exceed 0.06 s. Optionally, it is also envisaged that the viewer is able to adjust the subliminal period of time in order to optimally adapt it to his or her own sensitivity.

The trigger interval in turn defines at what time intervals the modification of the display parameter is performed. In tests, a trigger interval of between 5 and 20 s has proven to be suitable for sufficiently moistening the eye with tear fluid. To enable individual adaptation to the personal preferences and needs of a viewer, the trigger interval can be set to a value which is kept constant or varied randomly by the viewer of the display surface or by a random generator or the like. In a similar manner, the trigger interval can be adjusted according to a value profile, which value profile is, for example, a daily profile or a profile adapted to the ambient brightness. To provide (self) protection for the user, it is, however, also envisaged that the variability of the trigger interval is allowed only within predetermined limits.

The display system 1 can be implemented, for example, by a computer 8 with an attached display 2. The computer 8 in turn comprises the display modifying means 5 designed as an arithmetic unit as well as the display device 4 configured as a graphics card. In addition, the computer 8 comprises an internal memory 7 for processing computer programs which are loaded by a computer-readable medium 6 such as a diskette, a hard disk or via a data network such as the internet into the internal memory 7.

Although the method according to the invention for displaying visual information on a display surface can be implemented as a hardware device or chip, it is also perfectly suitable for software implementation by means of the computer 8, i.e., as a computer program product which is stored on the computer-readable medium 6 and can be processed in the computer 8. Different approaches can be selected for implementing the method according to the invention as will be illustrated further by way of the following examples.

In FIG. 2, the display surface 3 is illustrated for the case that the computer 8 has an operating system that allows the display of several superimposed display levels on a display surface. The visual information 9 is shown on the lowermost display level 3*a*. As the uppermost display level 3*b*, a transparent region is provided which is switched, for the subliminal period of time, into a mode which is not entirely transparent according to the display parameter P. The viewer of the display surface 3 does not notice anything of this subliminal change in the display. It should be noted that it is not necessary for the uppermost display level 3*b* to extend across the entire display surface 3 but that is has been regarded as sufficient for the functioning of the invention if said display level occupies only a part of the display surface 3. As said section, a region 3*c* can advantageously be chosen which attracts the viewer's attention, since a mouse pointer 10 or another indicator evoking the viewer's attention such as e.g. a cursor, an input field or another active screen element is located in said region 3*c*. According to an alternative embodiment, it is also possible to detect via attention detection means which are not illustrated, such as by iris identification, on what region of the display surface the viewer's attention is momentarily focussed, and the region wherein a display parameter is modified for the subliminal period of time can be selected accordingly. Furthermore, it is understood that the position and/or the size of the display levels 3*b* or of the display region 3*c*, respectively, can be varied.

If the computer 8 is designed for the illustration of display windows in the display surface 3, as schematically shown in FIG. 3, where a display window 11*a* contains the visual information 9, a transparent window 11*b* can be placed over at least one area of the visual information 9 and said transparent window 11*b* can be switched, for the subliminal period of time, into a mode which is not entirely transparent according to the display parameter. Instead of the window 11*b* which is switchable between a transparent mode and a mode which is not entirely transparent, a window 11*c* which is not entirely transparent can also be faded in for the subliminal period of time and then faded out. In an alternative embodiment, which is not shown, the display of the momentarily active display window can be altered for a subliminal period of time according to a display parameter, whereby this active window is acted upon by user inputs and, hence, it may be assumed that the user pays increased attention to this active window.

An essential feature of the invention is that the display of the visual information on the display surface is altered for a subliminally short period of time relative to the normal display to such an extent that the viewer will unconsciously be prompted to blink due to this momentary contrast. As mentioned above, in order to achieve this contrasting display, a display parameter comprising the brightness, colour, illumination, contrast, focus, frequency of the display or the like is modified for the subliminal period of time. For achieving the contrasting effect, it is likewise possible to completely disconnect and reconnect the display surface, provided that the display is able to respond with sufficient speed so that the disconnection and connection will remain in the subliminal range and is thus not perceived as screen flickering by the viewer.

In technical terms, the contrasting display on a display's display surface can be produced by image assembly and disassembly, pixel assembly and disassembly, image/pixel fade-in and fade-out, image/pixel superposition or image/pixel modification. In order to bring about the above-described modifications, the alpha value of a bit map can be set to a non-transparent value as far as the programming technique is concerned. The number of manipulated pixels can be varied, and a repeat timer defining the trigger interval can be programmed.

In order that the user can really be sure that the computer-implemented method according to the invention is indeed processed by the computer, an icon can, for example, be faded into a task bar of the display surface. However, it may also be provided that the user can switch the computer into a mode in which the modification of the display parameter is performed occasionally or by user action for a supraliminal period of time so that the user can consciously identify the display modification.

The display surface is not necessarily the image area of a display but, according to the invention, can also be a projection surface or a support surface provided with the visual information, such as, for example, a print. For example, a surface of an article, in particular of an industrial product, which surface is to be inspected visually by an operator can, however, also be regarded as a display surface. FIG. 4 shows an exemplary embodiment wherein visual information 15 is projected by a projector 14 or a computer controlled video beamer, respectively, onto a projection surface 13. People viewing the projection surface 13 are also subject to eye fatigue and the always similar focussing on the projection surface and consequently tend to refrain from blinking if the gaze is too intense. In order to prompt such viewers, according to the invention, to blink their eyes nevertheless, a second projector 16 is provided which, at trigger intervals, irradiates light 17 onto the projection surface 13 for a subliminally short period of time. Care should be taken that illuminants are used in the projector 16, which can be activated and deactivated within a subliminal period of time or can be covered by a diaphragm or the like. The projector 16 may be replaced by a lamp. Likewise, the two projectors 14, 16 or the projector 14, respectively, and a suitable lamp can be integral with each other so that only one lens system has to be used.

FIG. 5 schematically shows a further example as to how the method according to the invention can be implemented. In this example, the display surface consists, on the one hand, in a support surface provided with visual information, namely the opened pages of a book 20, and, on the other hand, in the surface of an article 21 to be inspected. In these examples, the display surface itself cannot, of course, be changed directly but results from irradiation with light 22 from a source of light 18. However, the problem of excessive eyestrain and, associated therewith, of failure to blink also arises during strenuous reading or intense viewing of the article 21 to be inspected. For carrying out the method according to the invention, a second source of light 19 is provided which is designed such that it can be activated and deactivated at trigger intervals for a subliminal period of time or can be covered by a diaphragm or the like for a subliminal period of time. The light 23 from the source of light 19 irradiates both the article 21 and the book 20 and superimposes the light 22 from the general source of light 18—however, only for the subliminal period of time—so that, due to this light superposition, it is possible to say that a display parameter of the display surface is modified by irradiating the display surface with light from the source of light 19. This embodiment of the invention is perfectly suitable for use in libraries or industrial production halls.

What is claimed is:

1. A method for displaying visual information on a display surface, wherein a display parameter is modified, at trigger intervals, in at least one region of the display surface for a subliminal period of time, several superimposed display levels including an uppermost display level being shown on the display surface, with a transparent region being provided as the uppermost display level in the at least one region of the display surface, which transparent region is switched, for the subliminal period of time, into a mode which is not entirely transparent according to the display parameter, wherein at least some of the display levels are shown in display windows and the transparent region is placed over at least one area of the visual information, wherein the display windows can be shown on the display surface and one of the display windows is selectable as an active display window acted upon by user inputs, wherein the display parameter is modified in the active window and in the transparent region.

2. The method according to claim 1, wherein the transparent region includes a transparent window placed over at least one area of the visual information, wherein the transparent window is switched, for the subliminal period of time, into a mode which is not entirely transparent according to the display parameter.

3. The method according to claim 1, wherein the active window is separate from the uppermost display level.

4. The method according to claim 1, wherein the several superimposed display windows can be shown on the display surface, wherein the modification of the region of the display surface is effected by means of a window faded in for the subliminal period of time and exhibiting display properties which have been predetermined by the display parameter.

5. The method according to claim 1, wherein the display parameter is selected from a group consisting of the brightness, color, illumination, contrast, focus, frequency and connection/disconnection of the display.

6. The method according to claim 1, wherein the subliminal period of time is adjustable.

7. The method according to claim 1, wherein the display parameter is modified in at least one region of the display surface for an optionally adjustable supraliminal period of time.

8. The method according to claim 1, wherein the trigger interval is adjustable to at least one of a value and a value profile by at least one of a user and a random generator.

9. The method according to claim 8, wherein the variability of the trigger interval lies within predetermined limits.

10. The method according to claim 1, wherein the display surface is integral with a display and the modification of the display parameter is caused by changing the control of the display.

11. The method according to claim 1, wherein the display surface is at least one of a projection surface and a support surface provided with the visual information and the modification of the display parameter comprises irradiating the display surface with light from at least one of a source of light and a projector for the subliminal period of time.

12. The method according to claim 1, wherein a display parameter is modified in such a region of the display surface in which at least one of a cursor, a mouse pointer, an input field, an active screen window and another indicator attracting the viewer's attention is located.

13. The method according to claim 1, wherein a display parameter is modified in such a region of the display surface on which the viewer's attention detected via attention detection means is focused.

14. A computer program product which is suitable for displaying visual information on a display surface and which is loadable directly into a memory of a computer and comprises software code portions, wherein the software code portions modify a display parameter, at trigger intervals, in at least one region of the display surface for a subliminal period of time, several superimposed display levels including an uppermost display level being shown on the display surface, with a transparent region being provided as the uppermost display level in the at least one region of the display surface, which transparent region is switched, for the subliminal period of time, into a mode which is not entirely transparent according to the display parameter, the software code portions being processed by means of the computer when the computer program product is processed on the computer, wherein at least some of the display levels are shown in display windows and the transparent region is placed over at least one area of the visual information, wherein the display windows can be shown on the display surface and one of the display windows is selectable as an active display window acted upon by user inputs, the display parameter being modified in the active window and in the transparent region.

15. The computer program product according to claim 14, wherein the computer program product is stored on a non-transitory computer-readable medium.

16. The computer program product according to claim 14, wherein the computer comprises an arithmetic unit and an internal memory which processes the computer program product.

17. The computer program product according to claim 16, wherein the computer includes an operating system that allows the display of several superimposed display levels on a display surface.

18. The computer program product according to claim 16, wherein the computer includes an operating system for the display of several display windows of which one display window is selectable as an active display window.

19. The computer program product according to claim 16, wherein the computer includes an operating system that allows the display of several superimposed display windows on a display surface.

20. A display system comprising a display and at least one display device which shows visual information on a display surface of the display, wherein display modifying means acts upon the display device, which display modifying means are designed to modify a display parameter, at trigger intervals, in at least one region of the display surface for a subliminal period of time, several superimposed display levels including an uppermost display level being shown on the display surface, with a transparent region being provided as the uppermost display level in the at least one region of the display surface, which transparent region is switched, for the subliminal period of time, into a mode which is not entirely transparent according to the display parameter, wherein at least some of the display levels are shown in display windows and the transparent region is placed over at least one area of the visual information, wherein the display windows can be shown on the display surface and one of the display windows is selectable as an active display window acted upon by user inputs, the display parameter being modified in the active window and in the transparent region.

21. The display system according to claim 20, wherein at least one of the position and the size of the region of the display surface which is modified is/are variable.

* * * * *